US008256635B2

(12) United States Patent
Schardein et al.

(10) Patent No.: US 8,256,635 B2
(45) Date of Patent: Sep. 4, 2012

(54) COLLAPSIBLE CARGO CONTAINER ASSEMBLY

(75) Inventors: David W. Schardein, Louisville, KY (US); Lawrence F. Bender, Louisville, KY (US)

(73) Assignee: Aero Containers International, LLC, Louisville, KY (US)

( * ) Notice: Subject to any disclaimer, the term of this patent is extended or adjusted under 35 U.S.C. 154(b) by 174 days.

(21) Appl. No.: 12/807,352

(22) Filed: Sep. 2, 2010

(65) Prior Publication Data

US 2012/0055919 A1 Mar. 8, 2012

(51) Int. Cl.
*B65D 6/00* (2006.01)
*B65D 8/14* (2006.01)

(52) U.S. Cl. ..... 220/6; 220/1.5; 220/4.28; 220/9.3

(58) Field of Classification Search ..... 220/1.5, 220/4.28, 4.32, 6, 7, 9.2, 9.3, 666, 668
See application file for complete search history.

(56) References Cited

U.S. PATENT DOCUMENTS

| | | | | |
|---|---|---|---|---|
| 3,645,596 | A | | 2/1972 | Russell-French |
| 3,659,641 | A | | 5/1972 | Marino |
| 3,715,843 | A | | 2/1973 | Ballinger |
| 3,868,155 | A | * | 2/1975 | Cherubini ..... 135/132 |
| 3,999,727 | A | * | 12/1976 | Rennemann ..... 206/298 |
| 4,684,034 | A | | 8/1987 | Ono et al. |
| 4,860,912 | A | | 8/1989 | Kupersmit |
| 5,279,437 | A | | 1/1994 | Kupersmit |
| 5,890,612 | A | | 4/1999 | Coppi |
| 5,941,405 | A | | 8/1999 | Scales et al. |
| 6,616,103 | B2 | | 9/2003 | Marrero |
| 7,540,390 | B2 | | 6/2009 | Bublitz et al. |
| 2010/0124862 | A1 | | 5/2010 | Smith |

* cited by examiner

*Primary Examiner* — Harry Grosso
(74) *Attorney, Agent, or Firm* — John R. Hoffman

(57) ABSTRACT

A collapsible cargo container assembly includes a collapsible skeleton framework defining a front, rear and opposite sides of the container assembly and includes a plurality of generally parallel ribs spaced from and generally planar to each other when the container assembly is in an open condition. A plurality of articulated braces are connected to and extend between the ribs to hold the ribs in spaced relationship in the open condition of the container assembly. The articulated braces are foldable to position the ribs in juxtaposition alongside each other in a collapsed condition of the container assembly. A flexible cover is positioned substantially about the collapsible framework and is fixed thereto for folding therewith as the framework moves back-and-forth between the open and collapsed conditions thereof.

36 Claims, 7 Drawing Sheets

COLLAPSIBLE CARGO CONTAINER ASSEMBLY

FIELD OF THE INVENTION

This invention generally relates to the art of collapsible containers and, particularly, to a collapsible cargo container assembly. The assembly is particularly useful in a cargo hold of an aircraft.

BACKGROUND OF THE INVENTION

Collapsible containers for use in the aircraft industry are known in the art for containing, storing and transporting various parcels. Although such containers are used primarily for various parcels, they even have been used for storing luggage in passenger aircraft. In the parcel industry, such containers act as sorting devices to sort the parcels by destination, for instance.

For example, collapsible containers have been fabricated of corrugated side panels which may be made of paper board or plastic. The panels actually are stamped from blanks and folded into a given configuration or shape. Such corrugated containers typically are too heavy, labor intensive to open and collapse and lack durability particularly at the fold lines or creases which become weak.

Other containers are made with frameworks which may or may not include side panels of sheet metal or canvas, but such containers do not fold sufficiently into small configurations. The present invention is directed to solving these problems and satisfying the need of providing a collapsible cargo container assembly which is tough, durable and flexible. The assembly is of light weight and can be collapsed to a configuration on the order of 10% of its expanded size. The container assembly is tear resistant, chemical resistant, fatigue resistant, UV resistant, flame resistant and with low gas permeability.

Although the invention is described herein for particular use in aircraft, it also is very useful on other transportation carriers such as trucks, trailers, ships and the like.

SUMMARY OF THE INVENTION

An object, therefore, of the invention is to provide a new and improved collapsible cargo container assembly of the character described.

In the exemplary embodiment of the invention, the container assembly basically includes a collapsible skeleton framework fabricated of material such as aluminum or a composite material. The framework is substantially surrounded or encapsulated by an outer shell or cover, such as of fiber reinforced flexible composite material.

As disclosed herein, the collapsible skeleton framework defines a front, rear and opposite sides of the container assembly. The framework includes a plurality of ribs, each of which extends generally planar in a front-to-rear direction. The ribs are spaced in a side-to-side direction when the container assembly is in an open condition. A plurality of articulated braces are connected to and extend between the ribs to hold the ribs in spaced relationship in the open condition of the container assembly. The articulated braces are foldable to position the ribs in juxtaposition alongside each other in a collapsed condition of the container assembly. The flexible cover is positioned substantially about at least the front, rear and opposite sides of the collapsible framework. The cover is fixed to the framework for folding therewith as the framework moves back-and-forth between the open and collapsed conditions thereof. The container assembly can take various sizes and may be sized for positioning on a pallet of industry standard dimensions.

The flexible cover preferably includes a floor portion spanning a bottom of the framework. The cover may include a plurality of seams between and extending generally parallel to the ribs to define reinforced fold lines for the cover between the ribs. Preferably, the cover includes a door at the front thereof to provide access to the interior of the container assembly. One vertical side edge of the door is integral with a front wall of the cover to provide an integral hinge means about which the door is opened and closed. An L-shaped zipper is provided between a top and opposite side of the door and the front wall of the cover to secure the door in a closed condition.

A plurality of handles are provided at the opposite sides of the container assembly to facilitate pulling the assembly from its collapsed condition to its open condition. The handles may be fixed to the cover or extend through the cover and be fixed to the framework.

Each of the ribs of the collapsible framework includes a front post portion extending vertically between a top and bottom of the container assembly, along with a rear post portion spaced rearwardly of the front post portion and extending vertically upwardly from the bottom of the container assembly. In the preferred embodiment of the invention, the rear post portion of each rib is shorter than the front post portion thereof, and a curved rib portion is fixed to and extends between the tops of the front and rear post portions. This defines an arcuate top-rear corner of the container assembly to conform to the rounded configuration of a cargo hold of an aircraft. As disclosed herein, at least the extreme outermost ribs at opposite sides of the collapsible framework include a brace portion fixed to and extending between the front and rear post portions of the rib. The brace portion may be fixed to and extend between bottom ends of the front and rear post portions to define bottom side corners of the framework and container.

In the preferred embodiment of the invention, each of the articulated braces which extend between the ribs of the collapsible framework, comprises a rod-like member pivotally mounted at opposite ends to adjacent ones of the ribs. Each articulated brace includes a hinge mechanism intermediate the opposite ends of the brace to allow for folding of the brace and the entire container assembly. Each articulated brace may include stop means to prevent the brace from opening and extending beyond a straight-line articulation. The brace may include a detent means to hold the brace in either an extended straight-line articulation in the open condition of the container assembly or a folded articulation in the collapsed condition of the container assembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
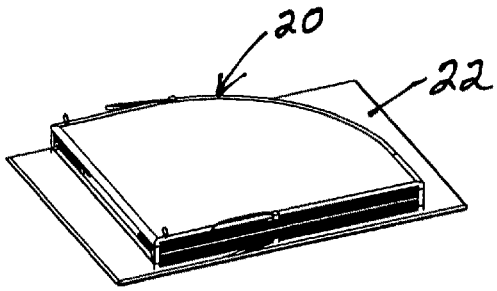
FIG. 1 is a perspective of one of the collapsible cargo container assemblies of the invention laying flat on top of a standard shipping pallet.

Referring to the drawings in greater detail, and first to FIG. 1, a collapsible cargo container assembly, generally designated 20, is shown laying flat on top of a standard shipping pallet 22. This one-on-one arrangement or combination is what might be expected in actual practice to readily use the assembly in a cargo facility. For instance, the combination of FIG. 1 may be stacked one on top of each other for immediate and ready use.

Figure 2:
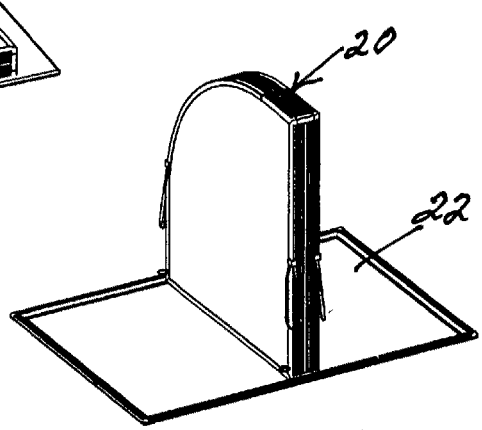
FIG. 2 is a view similar to that of FIG. 1, with the container assembly being moved to an upright position.

FIG. 2 shows collapsible container assembly 20 moved to an upright position on top of pallet 22, in the process of opening the container assembly.

Figure 3:
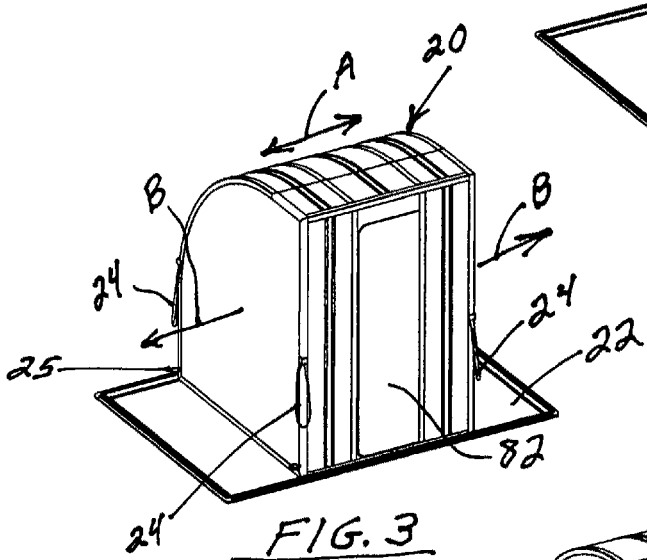
FIG. 3 is a view of the container assembly of FIG. 2 in the process of being expanded or opened in the direction of double-headed arrow "A"
Figure 4:
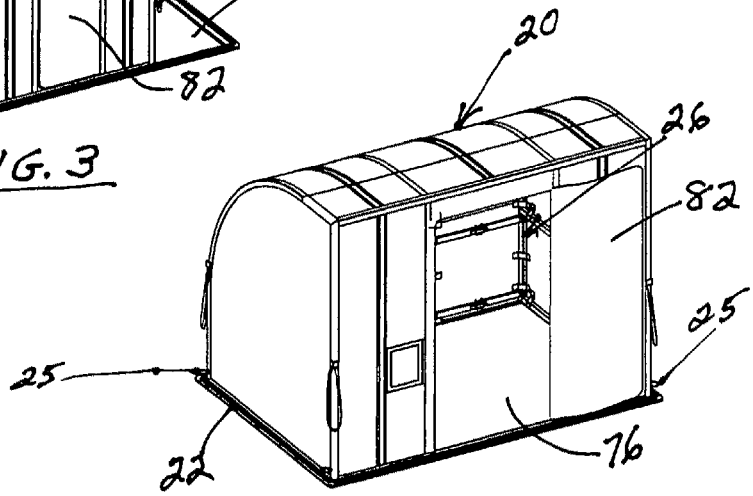
FIG. 4 is a view similar to that of FIG. 3, but with the container assembly in its fully open condition on top of the pallet.

The container assembly is expanded or opened from its collapsed condition of FIG. 2, in the direction of double-headed arrow "A" as seen in FIG. 3. A plurality of handles 24 (described hereinafter) are provided at opposite sides of the container assembly for pulling on the assembly in the direction of arrows "B" to fully open the container assembly as shown in FIG. 4. It can be seen that the fully opened container assembly substantially occupies the entirety of the top surface of pallet 22. A plurality of rings 25 are provided, such as at the corners of the assembly (also see FIGS. 5 and 6), for securing the assembly to pallet 22. For instance, appropriate securing straps can be inserted through the rings and through appropriate holes in the pallet.

Figure 5:
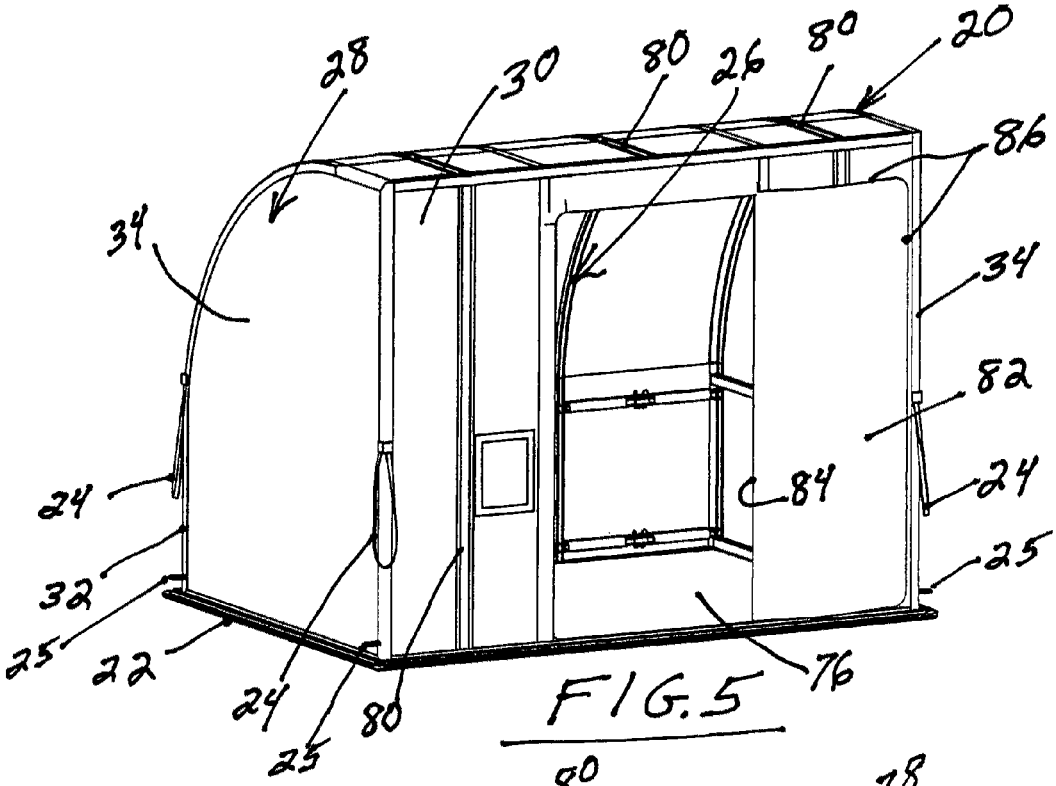
FIG. 5 is a perspective view identical to FIG. 4, but enlarged to facilitate the illustration.
Figure 6:
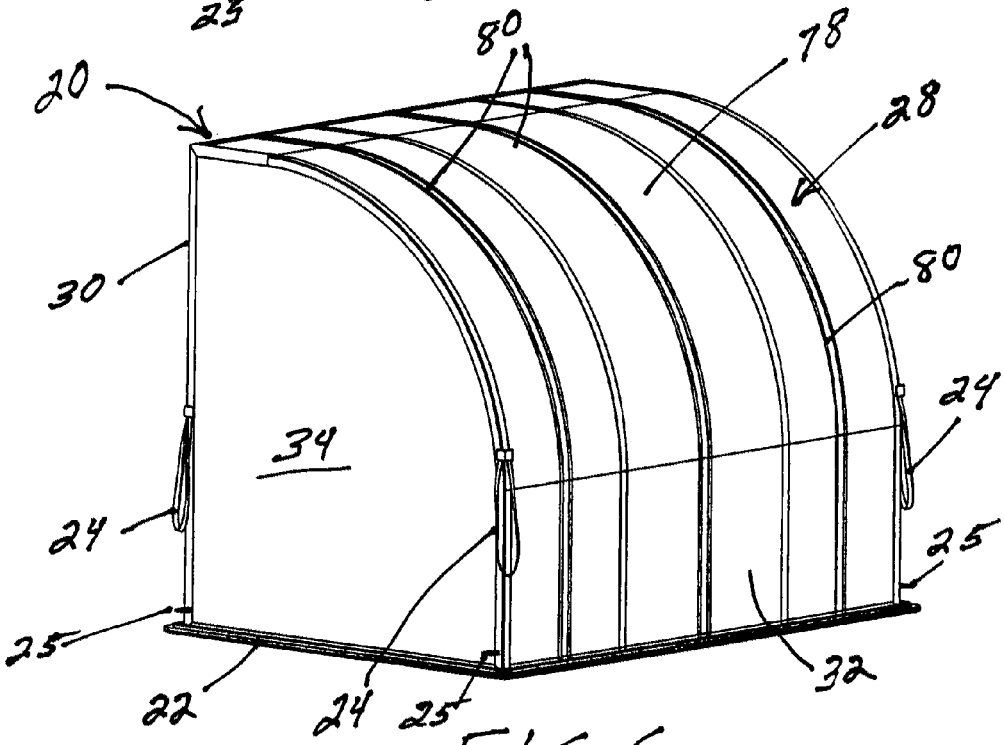
FIG. 6 is a perspective view looking at the rear of FIG. 5.

Referring to FIGS. 5 and 6, the collapsible cargo container assembly 20 generally includes an interior, collapsible skeleton framework, generally designated 26, surrounded or encapsulated by a flexible shell or cover, generally designated 28. As will become more clear hereinafter, framework 26 defines the specific configuration of container assembly 20, namely a front 30, a rear 32 and opposite sides 34 of the container assembly.

Figure 7:
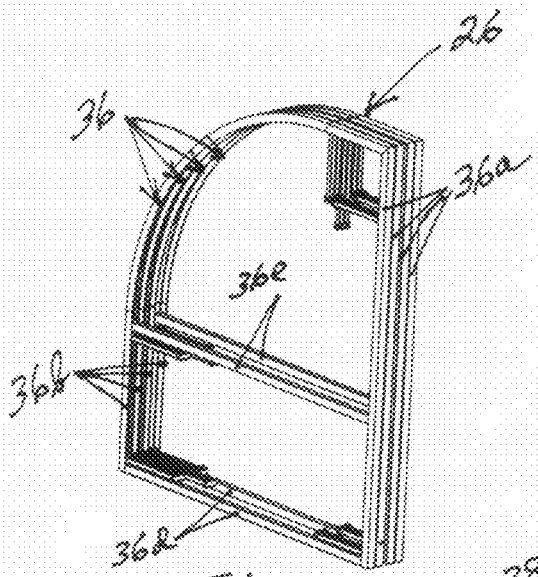
FIG. 7 is a perspective view of the collapsible skeleton framework in fully collapsed condition.

Flexible cover 28 will be described hereinafter, but reference first is made to FIGS. 7-9 to describe the collapsible framework 26 which defines the configuration of container assembly 20. FIG. 7 shows the collapsible framework in its fully collapsed condition, FIG. 9 shows the framework in its fully open condition, and FIG. 8 shows the framework in an intermediate or partially open condition.

Figure 9:
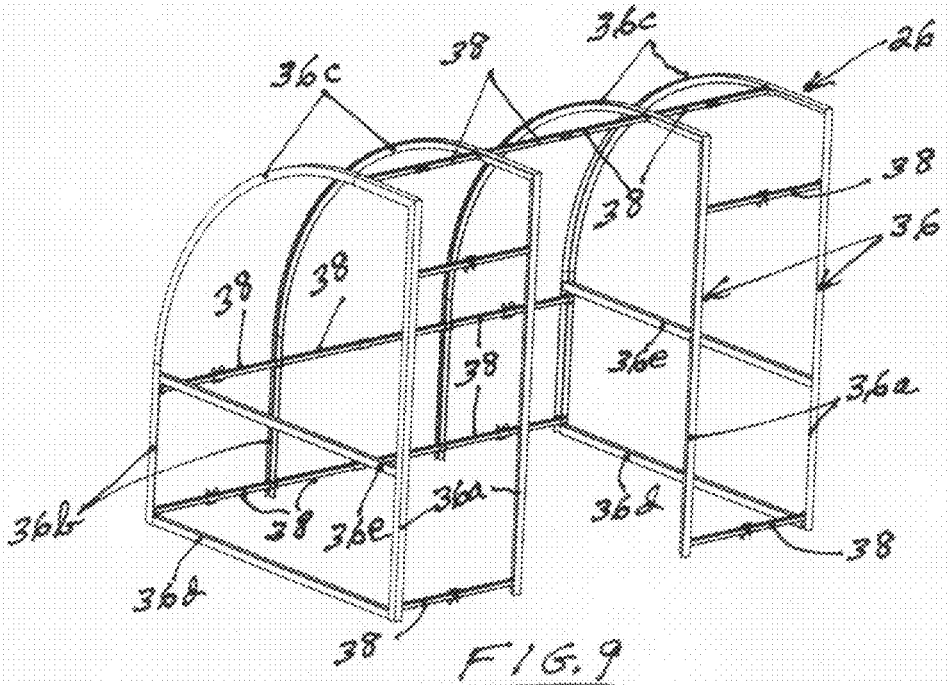
FIG. 9 is a perspective view of the framework fully opened, as might correspond to the condition of the container assembly in FIGS. 4 and 5.

Specifically, and referring particularly to FIG. 9, the collapsible skeleton framework includes a plurality of ribs, generally designated 36, each of which extends generally planar in a front-to-rear direction. It can be seen that the ribs are spaced in a side-to-side direction when the container assembly is in its open condition. Each rib includes a front post portion 36*a* which extends vertically between a top and bottom of the container assembly. Each rib includes a rear post portion 36 spaced rearwardly of the front post portion and extending vertically upwardly from the bottom of the container assembly. The rear post portion of each rib is shorter than the front post portion thereof, and a curved rear portion 36*c* is fixed to and extends between the tops of the front and rear post portions. These curved rib portions define an arcuate top-rear corner of the container assembly to conform to the rounded configuration of a cargo hold in an aircraft. It can be seen in FIG. 9 that the extreme outermost ribs 36 (at opposite sides of the collapsible framework) includes a front-to-rear brace portion 36*d* which is fixed to and extends between the bottom ends of the front and rear post portions 36*a* and 36*b*, respectively, to define bottom side corners of the framework and the expanded container assembly. An additional front-to-rear brace portion 36*e* is provided to help rigidify the extreme outermost ribs 36 of the collapsible framework.

Figure 8:
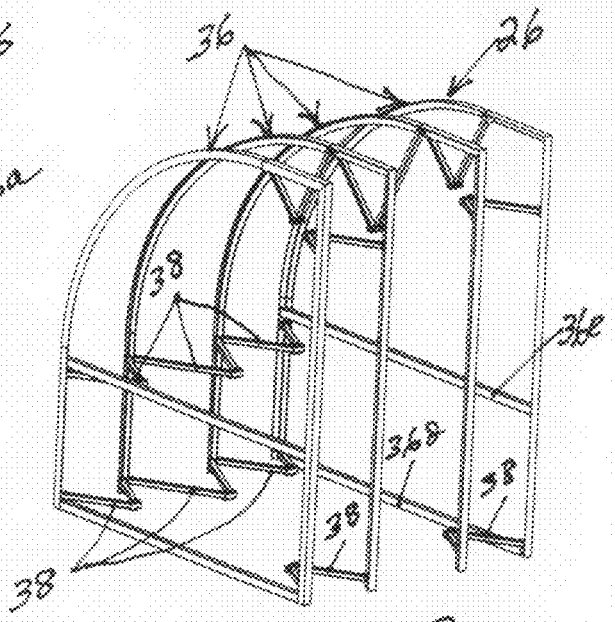
FIG. 8 is a view similar to that of FIG. 7, with the framework partially opened, as might correspond to the condition of the container assembly in FIG. 3.

Still referring to FIGS. 8 and 9, a plurality of articulated braces 38 are connected to and extend between ribs 36 to hold the ribs in spaced relationship in the open condition (FIG. 9) of the framework and container assembly. The articulated braces are foldable to position the ribs in juxtaposition alongside each other in the collapsed condition of the framework and container assembly as seen in FIGS. 7 and 2.

Figure 10:
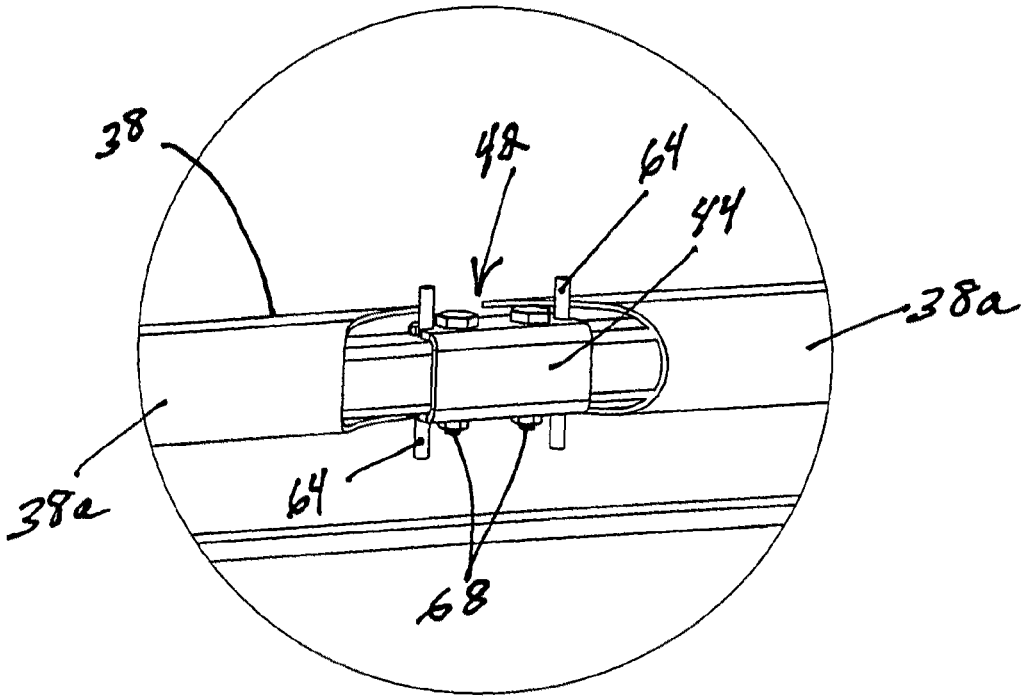
FIG. 10 is an enlarged, fragmented perspective view of the hinge mechanism at the mid-point of one of the articulated braces of the collapsible framework.
Figure 11:
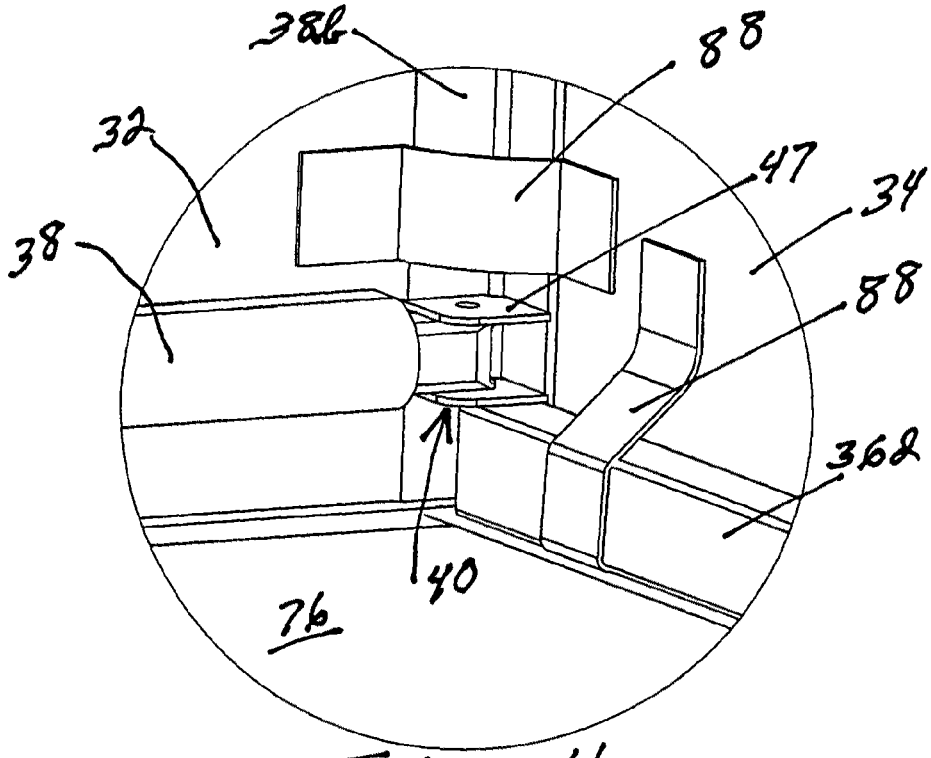
FIG. 11 is an enlarged, fragmented perspective view of the pivoted end of one of the articulated braces and also showing straps for fixing the cover to the framework.

Each articulated brace 38 is a rod-like member, and opposite ends of each brace are pivotally mounted to adjacent ones of ribs 36 by pivot connections, generally designated 40, shown in FIG. 11. Each articulated brace 38 includes a hinge mechanism, generally designated 42 (FIG. 10), intermediate its opposite ends to allow for folding of the articulated brace. FIG. 10 shows that each hinge mechanism includes a stop plate 44 which prevents the respective brace from opening and extending beyond a straight-line articulation. Therefore, each articulated brace 38 includes a brace portion 38*a* which extends from each opposite side of hinge mechanism 42 to an opposite end of the articulated brace which is pivotally fixed to the respective rib 36 at one of the pivot connections 40 (FIG. 11).

Figure 12:
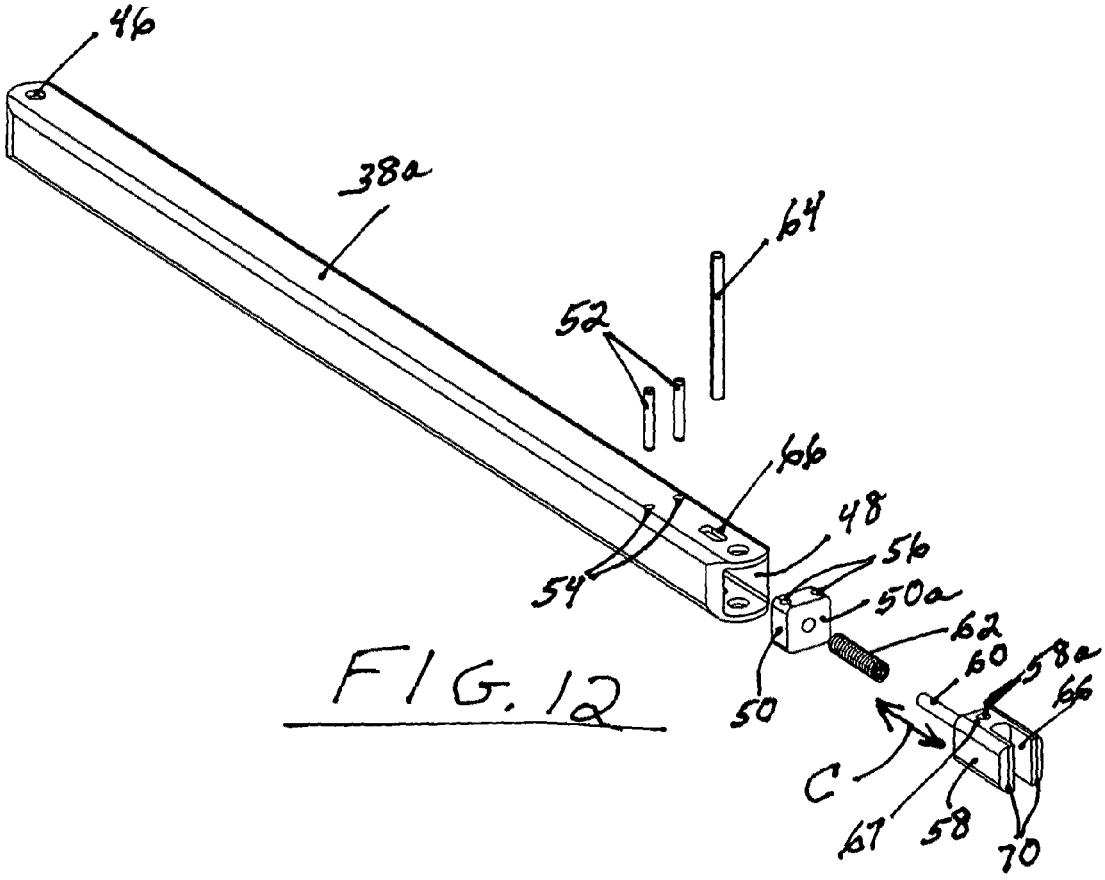
FIG. 12 is an exploded perspective view of the detent hinge components at an inner end of one-half of one of the articulated braces.

FIG. 12 shows one of the brace portions 38*a* which forms one-half of each the articulated brace 38. An outer end of the brace portion includes a vertical hole 46 for receiving a pivot pin (not visible in the drawings) of pivot connection 40 (FIG.

11). The pivot pin extends through a pivot bracket 47 (FIG. 11) of pivot connection 40. The opposite end of the brace portion is hollow, as at 48, for receiving various components of hinge connection 42 (FIG. 10). Specifically, a plug 50 is inserted into hollow end 48 and is fixed within the brace portion by means of a pair of split spring pins 52 extending through a pair of holes 54 in the brace portion and a pair of holes 56 in the plug. A piston 58 is inserted into hollow end 48 of the brace portion and includes an inwardly extending rod 60 onto which a coil spring 62 is positioned. The coil spring is sandwiched between a face 50*a* of plug 50 and an inner face 58*a* of piston 58. A split spring pin 64 is inserted through an elongated hole 66 at the end of brace portion 38*a* and is fixed in a hole 67 in piston 58. A bolt 68 (FIGS. 13-15) extends through and moves within a slot 69 in the outer end of piston 58. Therefore, the piston is movable relative to the brace portion and plug 50 in the direction of arrow "C", under the compression of coil spring 62, as bolt 68 can simply ride within slot 69 of the piston while pin 64 rides in elongated hole 66.

Figure 13:
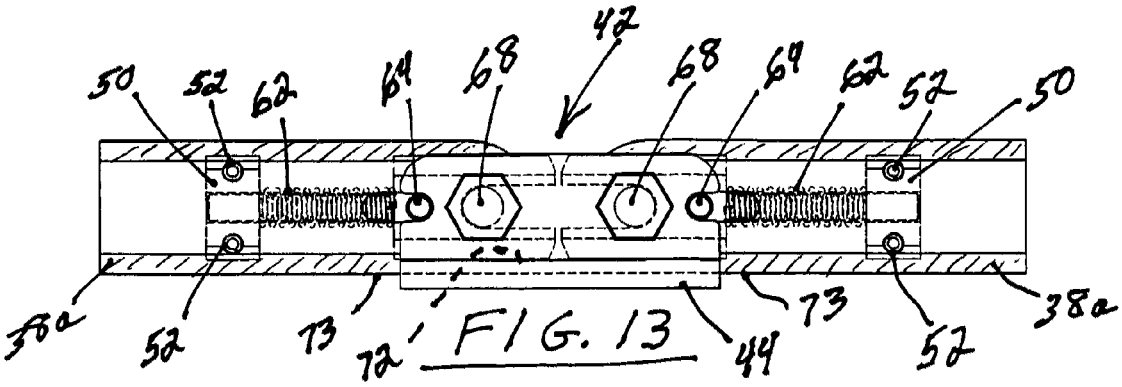
FIG. 13 is a view of one of the hinge mechanisms, as looking down onto the mechanism in FIG. 10, but with the articulated brace fully extended in a straight-line articulation.
Figure 14:
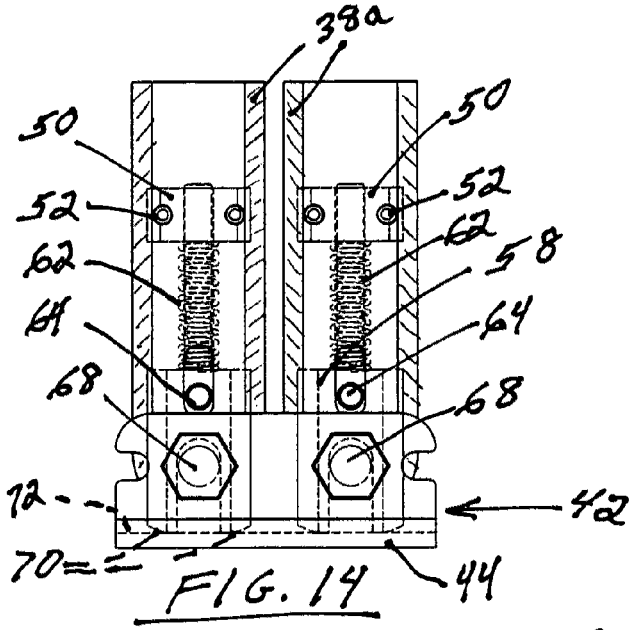
FIG. 14 is a view similar to that of FIG. 13, but with the articulated brace in its fully folded condition.
Figure 15:
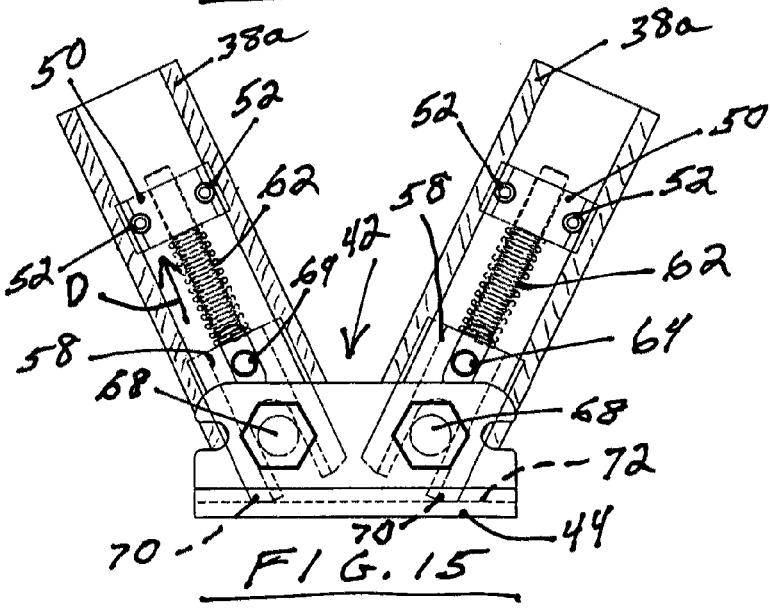
FIG. 15 is a view similar to that of FIGS. 13 and 14, but with the articulated brace partially between its folded and extended positions.

FIGS. 13-15 show the components of hinge mechanism 42 in adjoining ends of the two brace portions 38 of a single articulated brace, as described immediately above in relation to FIG. 12. Stop plate 44 pivotally joins the adjacent ends of brace portions 38*a*, through bolts 68. FIG. 1 shows the hinge mechanism when the articulated brace is in a straight-line articulation which corresponds to the fully open condition of framework 26 as seen in FIG. 9. FIG. 14 shows the condition of the hinge mechanism when brace portions 38*a* are parallel to each other in the fully folded condition of the articulated brace, corresponding to the fully folded position of framework 26 as shown in FIG. 7. FIG. 15 shows a condition of brace portions 38*a* of a single articulated brace when the brace portions are midway between their fully extended positions (FIG. 3) and their fully folded positions (FIG. 14).

The depiction of FIG. 15 shows a unique feature of hinge mechanism 42 which provides a detent means to hold the braces and, therefore, the collapsible framework in either the open or collapsed conditions. Specifically, FIG. 15 shows that corners 70 of pistons 58 within the opposing hollow ends of brace portions 38*a* ride along an inside surface 72 of stop plate 44. This pushes the pistons inwardly in the direction of arrow "D", compressing coil springs 62, and "cocking" the pistons. FIG. 15 can represent the condition of the brace portions when moving from their relative extended positions to their folded positions or from the folded positions to the extended positions. With that understanding, when the brace portions are in their extended or straight-line articulation as shown in FIG. 13, flat sides 73 of the brace portions abut against the inner flat surface 72 of stop plate 44. Pistons 58 no longer are "cocked" and this abutment of the adjacent surfaces form a detent position to hold the brace portions and the articulated brace, itself, in an extended straight-line articulation. FIG. 14 shows that all four corners 70 of brace portions 38*a* abut against flat surface 72 of stop plate 44 and, with pistons 58 no longer "cocked", the coil springs bias the pistons against flat surface 72 to define a detent position for the articulated brace to hold the brace in the folded condition thereof.

From the foregoing description of FIGS. 12-15, it can be understood that the construction of hinge mechanisms 42 provide a distinct detent means to define discrete open and collapsed conditions of the container assembly. FIGS. 8 and 9 show that there are or can be as many as thirteen articulated braces 38, each of which has a hinge mechanism 42. It can be understood that coil springs 62 do not have to be large springs, because the combined spring forces of all thirteen hinge mechanisms clearly provide a detent system whereby the entire container assembly literally "snaps" into its collapsed and open conditions.

Referring back to FIGS. 5 and 6, cover 28 is configured to conform to the outer profile of collapsible framework 26 as seen in FIG. 9. Basically, the cover has a front, rear and opposite sides corresponding to the front 30, rear 32 and opposite sides 34, respectively, of container assembly 20 as described above in relation to FIG. 5. In addition, the cover has a floor portion 76 (FIG. 5) which spans the bottom of the framework. The cover also has a curved or arcuate top 78 which conforms to the curved rib portions 36*c* (FIG. 9) of ribs 36. The cover is fabricated of flexible material and can be made of pieces which are seamed together at seams 80 (FIG. 5) which extend generally parallel to the ribs to define reinforced fold lines for the cover between the ribs. In other words, seams 80 could extend equidistant between and parallel to the ribs.

The cover includes a door 82 at the front thereof to provide access to the interior of the container assembly. One vertical side edge 84 of the door is integral with the front wall of the cover to provide an integral hinge means about which the door is opened and closed. An L-shaped zipper 86 is provided between a top and opposite side of the door and the front wall of the cover to secure the door in a closed condition. Flaps (not shown) may be provided to cover the zipper to prevent leaking. Although, the door is shown at the front of the container assembly, the door can be located elsewhere about the assembly. In addition, the door could cover the entire front of the assembly.

The flexible cover substantially encapsulates the collapsible framework 26. This can be accomplished by collapsing the framework, inserting the framework through the door of the cover and then expanding the framework from within the cover. The cover then is fixed to the framework for folding therewith as the framework moves back-and-forth between the open and collapsed conditions thereof. To this end, to provide for easy folding, it is contemplated that the cover be fixed to the outside of the framework. This could be done by adhesives. In the alternative, and referring to FIG. 11, a plurality of straps 88 can be provided throughout the interior of the container assembly to secure the cover to the framework. These straps can be secured by various means, including the use of Velcro securement.

The handles 24, described above in relation to FIG. 3, can be reinforced flexible straps secured to the container assembly by various means. For instance, the straps can be sewn directly to the cover. Alternatively, the handles can extend through sealed holes in the cover and be secured directly to the ribs of the framework.

It is contemplated that cover 28 be fabricated of a material which has particular properties. The cover should be lightweight as can be accomplished by a fiber reinforced flexible composite material. In other words, the reinforcing fibers are laminated to a high performance film using a matrix that is characterized by its toughness, durability, flexibility, tear resistant, chemical resistant, fatigue resistant and UV resistant. The matrix should have a low gas permeability and not support bacterial growth. The cover should be flame resistant and should not ignite, burn, char, shrink or significantly decompose when exposed to intense flame, molten metal, arc flash or high heat.

The above properties of the cover can be achieved by a woven or non-woven or knitted fabric bonded together by a high performance film or matrix or laminated to surface coatings. Just one example could be aromatic polyamide (aramid or para-aramid) fibers. Carbon or carbonized fibers might be used to withstand intense flame, molten metal, arc flash or high heat. These are but some examples. The matrix can be of a wide variety also, to be chemical resistant, moisture resistant, UV resistant or the like.

Figure 16:
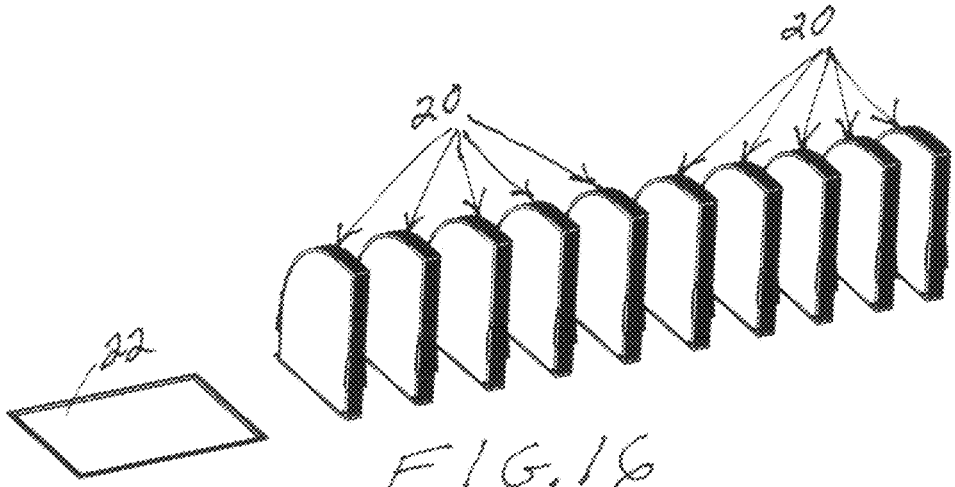
FIG. 16 is a somewhat schematic illustration of ten collapsible container assemblies of the invention about to be stacked horizontally on a standard shipping pallet.
Figure 17:
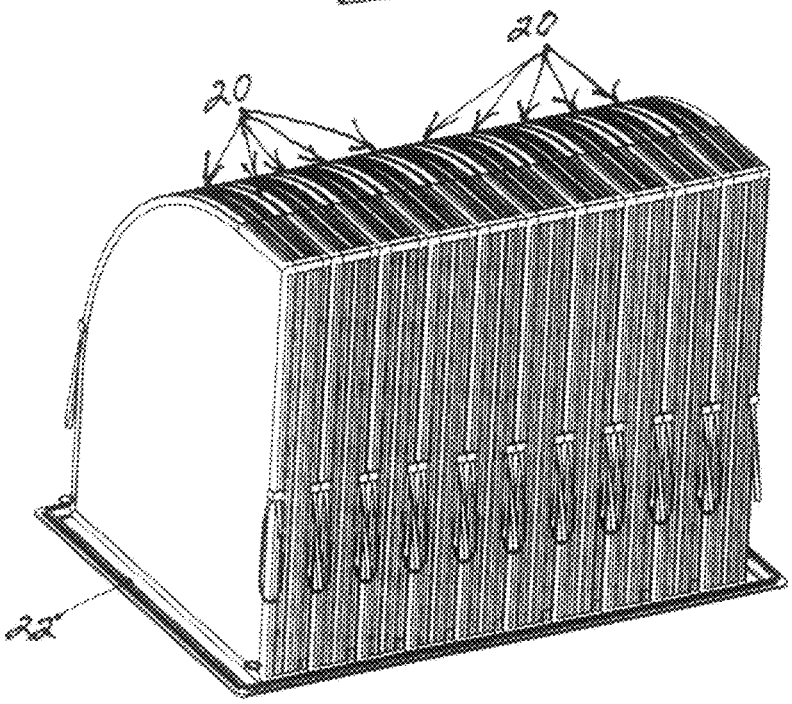
FIG. 17 is an enlarged depiction showing how all ten container assemblies occupy less than the space of a fully opened container assembly as shown in FIG. 5.

Lastly, FIGS. 16 and 17 show how ten container assemblies 20 can be stacked in a horizontal direction on top of pallet 22. In other words, the ten container assemblies are collapsed and are upright as shown in and described above in relation to FIG. 2. By comparing FIG. 17 with FIG. 4, it can immediately be seen that the components of the container assembly are sized and dimensioned so that ten (10) container assemblies 20, when collapsed and stacked, take up substantially the same space as one (1) container assembly in its expanded or open condition.

When the collapsed container assemblies are stacked horizontally and placed on pallet 22 as shown in FIG. 17, the entire assembly (including the containers and the pallet) can be strapped or banded together and shipped from place to place. Alternatively, a net or shroud can be placed over all the stacked container assemblies to hold them together during shipment.

Although container assembly 20 has been shown and described herein as having a rounded top at the rear thereof, other shapes are contemplated by the invention. The container assembly could be rounded at the front. It could be rounded at opposite sides, with progressively sized ribs 36. It could be box-shaped such a cube or a rectangular shape.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A collapsible cargo container assembly, comprising:

a collapsible skeleton framework defining a front, rear and opposite sides of the container assembly and including a plurality of ribs each of which extends generally planar in a front-to-rear direction, the ribs being spaced in a side-to-side direction when the container assembly is in an open condition, a plurality of articulated braces connected to and extending between the ribs to hold the ribs in spaced relationship in the open condition of the container assembly, and the articulated braces being foldable to position the ribs in juxtaposition alongside each other in a collapsed condition of the container assembly; and a flexible cover substantially about at least the front, rear and opposite sides of the collapsible framework, the cover being fixed to the framework for folding therewith as the framework moves back-and-forth between the open and collapsed conditions thereof.

2. The collapsible cargo container assembly of claim 1 wherein said cover includes a floor portion spanning a bottom of the framework.

3. The collapsible cargo container assembly of claim 1 wherein said cover includes a plurality of seams between and extending generally parallel to the ribs to define reinforced fold lines for the cover between the ribs.

4. The collapsible cargo container assembly of claim 1 wherein said cover includes a door at the front thereof to provide access to the interior of the container assembly.

5. The collapsible cargo container assembly of claim 4 wherein one vertical side edge of the door is integral with a front wall of the cover to provide an integral hinge means about which the door is opened and closed.

6. The collapsible cargo container assembly of claim 5, including an L-shaped zipper between a top and opposite side of the door and the front wall of the cover to secure the door in a closed condition.

7. The collapsible cargo container assembly of claim 1, including a plurality of handles at the opposite sides of the container assembly to facilitate pulling the assembly from its collapsed condition to its open condition.

8. The collapsible cargo container assembly of claim 1 wherein each of said ribs includes a front post portion extending vertically between a top and bottom of the container assembly.

9. The collapsible cargo container assembly of claim 8 wherein each of said ribs includes a rear post portion spaced rearwardly of the front post portion and extending vertically upwardly from the bottom of the container assembly.

10. The collapsible cargo container assembly of claim 9 wherein the rear post portion of each rib is shorter than the front post portion thereof, and including a curved rib portion fixed to and extending between the tops of the front and rear post portions to define an arcuate top-rear corner to the container assembly to conform to the rounded configuration of a cargo hold of an aircraft.

11. The collapsible cargo container assembly of claim 9 wherein at least the extreme outermost ribs at opposite sides of the collapsible framework include a brace portion fixed to and extending between the front and rear post portions of the rib.

12. The collapsible cargo container assembly of claim 11 wherein said brace portion is fixed to and extends between bottom ends of the front and rear post portions to define bottom side corners of the framework and container.

13. The collapsible cargo container assembly of claim 1 wherein each of said articulated braces comprises a rod-like member pivotally mounted at opposite ends to adjacent ones of said ribs.

14. The collapsible cargo container assembly of claim 13 wherein each of said articulated braces includes a hinge mechanism intermediate said opposite ends to allow for folding of the articulated braces.

15. The collapsible cargo container assembly of claim 14 wherein at least some of said articulated braces include stop means to prevent the braces from opening and extending beyond a straight-line articulation.

16. The collapsible cargo container assembly of claim 14 wherein at least some of said articulated braces include detent means to hold the braces in an extended straight-line articulation.

17. A collapsible cargo container assembly, comprising:

a collapsible skeleton framework defining a front, rear and opposite sides of the container assembly and including a plurality of ribs each of which extends generally planar in a front-to-rear direction, the ribs being spaced in a side-to-side direction when the container assembly is in an open condition, each of said ribs including a front post portion extending vertically between a top and bottom of the container assembly and a rear post portion spaced rearwardly of the front post portion and extending vertically upwardly from the bottom of the container assembly, a plurality of articulated braces connected to and extending between the ribs to hold the ribs in spaced relationship in the open condition of the container assembly, the articulated braces being foldable to position the ribs in juxtaposition alongside each other in a collapsed condition of the container assembly, each of said articulated braces comprising a rod-like member pivotally mounted at opposite ends to adjacent ones of said ribs; and a flexible cover substantially about at least the front, rear and opposite sides of the collapsible framework, the cover being fixed to the framework for folding therewith as the framework moves back-and-forth between the open and collapsed conditions thereof.

18. The collapsible cargo container assembly of claim 17 wherein the rear post portion of each rib is shorter than the front post portion thereof, and including a curved ribs portion fixed to and extending between the tops of the front and rear post portions to define an arcuate top-rear corner to the container assembly to conform to the rounded configuration of a cargo hold of an aircraft.

19. The collapsible cargo container assembly of claim 17 wherein at least the extreme outermost ribs at opposite sides of the collapsible framework include a brace portion fixed to and extending between the front and rear post portions of the rib.

20. The collapsible cargo container assembly of claim 19 wherein said brace portion is fixed to and extends between bottom ends of the front and rear post portions to define bottom side corners of the framework and container.

21. The collapsible cargo container assembly of claim 17 wherein each of said articulated braces includes a hinge mechanism intermediate said opposite ends to allow for folding of the articulated braces.

22. The collapsible cargo container assembly of claim 21 wherein at least some of said articulated braces include stop means to prevent the braces from opening and extending beyond a straight-line articulation.

23. The collapsible cargo container assembly of claim 21 wherein at least some of said articulated braces include detent means to hold the races in an extended straight-line articulation.

24. The collapsible cargo container assembly of claim 17 wherein said cover includes a floor portion spanning a bottom of the framework.

25. The collapsible cargo container assembly of claim 17 wherein said cover includes a plurality of seams between and extending generally parallel to the ribs to define reinforced fold lines for the cover between the ribs.

26. The collapsible cargo container assembly of claim 17 wherein said cover includes a door at the front thereof to provide access to the interior of the container assembly, one vertical side edge of the door being integral with a front wall of the cover to provide an integral hinge means about which the door is opened and closed, and including an L-shaped zipper between a top and opposite side of the door and the front wall of the cover to secure the door in a closed condition.

27. The collapsible cargo container assembly of claim 17, including a plurality of handles at the opposite sides of the container assembly to facilitate pulling the assembly from its collapsed condition to its open condition.

28. A collapsible cargo container assembly, comprising:

a collapsible skeleton framework defining a front, rear and opposite sides of the container assembly and including a plurality of generally parallel ribs spaced from and generally planar to each other when the container assembly is in an open condition, a plurality of articulated braces connected to and extending between the ribs to hold the ribs in spaced relationship in the open condition of the container assembly, and the articulated braces being foldable to position the ribs in juxtaposition alongside each other in a collapsed condition of the container assembly; and a flexible cover substantially about the collapsible framework and fixed thereto for folding therewith as the framework moves back-and-forth between the open and collapsed conditions thereof.

29. The collapsible cargo container assembly of claim 28, including a plurality of handles at the opposite sides of the container assembly to facilitate pulling the assembly from its collapsed condition to its open condition.

30. The collapsible cargo container assembly of claim 28 wherein said cover includes a door at the front thereof to provide access to the interior of the container assembly.

31. The collapsible cargo container assembly of claim 28 wherein said cover includes a floor portion spanning a bottom of the framework.

32. The collapsible cargo container assembly of claim 28 wherein each of said articulated braces comprises a rod-like member pivotally mounted at opposite ends to adjacent ones of said ribs.

33. The collapsible cargo container assembly of claim 32 wherein each of said articulated braces includes a hinge mechanism intermediate said opposite ends to allow for folding of the articulated braces.

34. The collapsible cargo container assembly of claim 33 wherein said hinge mechanism includes detent means to hold the articulated bases in either an extended straight-line articulation or a folded articulation.

35. The collapsible cargo container assembly of claim 28 wherein the container assembly is sized for positioning within the bounds of a standard sized shipping pallet.

36. The collapsible cargo container assembly of claim 28 wherein said framework and cover are sized and dimensioned so that ten collapsed container assemblies can be stacked to take up substantially the same space as one container assembly in its open condition.

* * * * *